United States Patent [19]

McCoy, Jr.

[11] Patent Number: 4,492,516

[45] Date of Patent: Jan. 8, 1985

[54] METHOD AND APPARATUS FOR CONTROLLING RECIRCULATION IN A CENTRIFUGAL PUMP

[75] Inventor: James J. McCoy, Jr., Houston, Tex.

[73] Assignee: Tenneco, Inc., Houston, Tex.

[21] Appl. No.: 428,636

[22] Filed: Sep. 30, 1982

[51] Int. Cl.[3] ..... F01D 1/12

[52] U.S. Cl. ..... 415/53 T; 415/53 R; 415/213 T

[58] Field of Search ..... 415/11, 53 R, 53 T, 415/157, 158, 56, 145, 144, 213 T

[56] References Cited

U.S. PATENT DOCUMENTS

| | | | |
|---|---|---|---|
| 933,906 | 9/1909 | Illy | 60/347 |
| 2,341,163 | 2/1944 | Schjolin | 60/347 |
| 2,611,241 | 9/1952 | Schulz | 415/143 |
| 2,865,297 | 12/1958 | Cliborn et al. | 415/53 |
| 3,751,178 | 8/1973 | Paugh et al. | 415/56 |
| 4,027,993 | 6/1977 | Wolff | 415/116 |

FOREIGN PATENT DOCUMENTS

| | | | |
|---|---|---|---|
| 47910 | 10/1979 | Japan | 415/53 R |

*Primary Examiner*—Edward G. Favors
*Assistant Examiner*—John Kwon
*Attorney, Agent, or Firm*—Arnold, White & Durkee

[57] ABSTRACT

S-shaped passageways are provided for reinjecting fluid from the discharge of a centrifugal pump to the impeller inlet of the pump, in order to prevent recirculation and the cavitation damage that results from recirculation. The S-shaped passageways impart a rotation to the reinjected fluid which is opposite to the direction of rotation of the impeller. The S-shaped passageways have intake openings near the discharge tips of the impeller which are adapted to receive fluid so that the momentum of the fluid, as it is expelled from the impeller, will carry the fluid directly into the intake of the S-shaped passageways. The S-shaped passageways are shaped to redirect the flow of the fluid to be reinjected so that the fluid exits the S-shaped passageways at the inlet of the impeller in a direction which is at a generally small angle of attack with respect to the impeller vanes. The S-shaped passageways are arranged in side-by-side relation to form an annular reinjection port.

25 Claims, 5 Drawing Figures

METHOD AND APPARATUS FOR CONTROLLING RECIRCULATION IN A CENTRIFUGAL PUMP

BACKGROUND OF THE INVENTION

This invention relates generally to controlling recirculation and cavitation in a centrifugal pump at reduced flow rates by reinjecting fluid into the inlet of the impeller of the centrifugal pump.

More particularly, this invention concerns a method and apparatus for transferring fluid from the discharge of the impeller and reinjecting such fluid through an annular reinjection port near the inlet or suction of the impeller. Passageways are used to transfer the reinjection fluid from the discharge to the inlet of the centrifugal pump, and the passageways are shaped so that the fluid will be reinjected into the inlet of the pump in an optimum fashion, imparting a flow direction that produces a minimum angle of attack with respect to the impeller blades.

A wide variety of fluids (including water, hydrocarbons, slurries, air, natural gas, and other liquid and gaseous materials) are pumped using centrifugal pumps.

A centrifugal pump has an impeller 10 mounted on a shaft 11. The impeller 10 and the shaft 11 are rotatably mounted in a housing or casing 12. A motor or other power source (not shown) is used to rotate the shaft 11.

Fluid is pumped through a centrifugal pump by rotating the impeller 10 and the shaft 11. This rotation creates a suction at the inlet 13 of the pump by imparting momentum to the fluid, causing the fluid to travel through the impeller 10 and out the discharge tips 14 into the discharge annulus or discharge header 15. The discharge header 15 is connected to, or in fluid communication with, an output pipe or conduit through which the fluid is pumped. The inlet 13 of the pump is typically connected to a pipe or conduit through which fluid flows toward the centrifugal pump.

Centrifugal pumps have a certain flow rate at which the pump operates most effectively, which is commonly referred to in the art as the best efficiency point. A centrifugal pump can operate effectively only over a limited range of flow rates above and below its best efficiency point. As used herein, flow rate is the rate of flow of fluid through the input pipe connected to the input 16 of the pump.

At low flow rates, the direction of flow of a portion of the fluid at the inlet 13 of the impeller 10 may actually reverse. Flow reversal may also occur at the discharge tips 14 of the impeller 10. Flow reversal at the inlet or at the discharge tips of the impeller in a centrifugal pump is known in the art as "recirculation". All impellers will exhibit recirculation at some reduced flow rate. Depending on the size and speed of the pump, and the fluid being pumped, the effect of recirculation can be very damaging.

If a pump is operated at low flow rates, significant adverse consequences may result due to recirculation. The consequences of recirculation can include cavitation damage to the impeller vanes at the inlet to the impeller, impeller and case erosion, cavitation damage to the vanes at the discharge of the impeller, random crackling noise and noisy operation, shaft deflection and stress, axial movement of the shaft, radial and thrust bearing failures, cracking or failure of the impeller shrouds at the discharge of the impeller, shaft failures, seal problems, surging in the suction of the centrifugal pump, and high vibration at low flow rates. Recirculating fluid can erode metal impeller vanes as if the metal vanes were subjected to constant high velocity sandblasting.

It is inherent in the dynamics of the pressure field that, if the flow rate is reduced, every impeller design must recirculate at some point—it cannot be avoided. A description of the problem of recirculation appears in an article authored by Warren H. Fraser, entitled "Flow Recirculation in Centrifugal Pumps", which is incorporated herein by reference. The reversal of flow of part of the fluid, at the same time that a portion of the fluid is entering the impeller, usually produces vortices which cavitate and produce random sharp crackling noise.

Recirculation at the inlet of a centrifugal pump is sometimes referred to as "suction recirculation."

The reversal of flow of fluid, or backflow, at the pump inlet is believed to occur mainly in the vicinity of the circumference of the inlet pipe wall, with the center of the stream of fluid continuing to exhibit forward flow. In other words, fluid in the center of the input 16 may flow toward the pump, while fluid around the outside, or around the circumference, may reverse and flow away from the pump.

A vortex may form at the inlet of the centrifugal pump due to suction recirculation. A fixed vortex may be produced that travels around with the rotation of the impeller vanes. This vortex will typically cavitate at its core and attack the metal surface of the pressure side of the vanes.

Reversal of flow at the discharge of the impeller may also occur. This is sometimes referred to as "discharge recirculation." Recirculation at the discharge of the impeller may produce a vortex that rotates with the impeller vanes. If the velocities of the reverse flow are of sufficient magnitude, the vortex will cavitate and attack the metal surface of the vanes. Vortices in the inlet of the impeller may possibly induce discharge recirculation.

A third phenomenon, sometimes loosely referred to in the art as "recirculation", involves the flow of fluid from the impeller discharge back to the suction through the wear ring clearances. This should be referred to instead as "wear ring leakage", and may normally occur in any pump.

One way of expanding the range of flow rates over which a centrifugal pump may operate is to provide for the reinjection of fluid from the discharge of the impeller back to the inlet of the impeller. The effective flow through the impeller, which may be referred to as the "apparent flow rate", may be increased, even though the actual flow rate into the input and out the discharge header is low. Thus, the apparent flow rate may be maintained within an acceptable range of operation for the centrifugal pump.

This invention relates to an improved means for reinjecting fluid into the inlet of the impeller of a centrifugal pump to maintain effective operation of the pump at reduced flow rates.

In the past, proposals have been advanced for reinjecting fluid which failed to consider the angle or direction of flow of the reinjected fluid. In order to effectively minimize the recirculation vortex that is formed the fluid must be reinjected at a proper angle and in a proper direction. It is important to direct the reinjected fluid directly into the inlet of the impeller at the proper angle and in the proper direction.

Cliborn's U.S. Pat. No. 2,865,297 illustrates a device which fails to control the direction in which fluid is reinjected. Cliborn fails to utilize the momentum of the fluid which is discharged from the impeller to propel the fluid through the reinjection passageway. Cliborn appears to rely solely on pressure differentials to urge the reinjection fluid through the reinjection passageway. In Cliborn, the kinetic energy of the fluid must be converted to potential energy in the form of pressure, and the fluid must then be reaccelerated toward the input of the pump.

Proposals have been advanced to place an inducer in front of the impeller. Two such proposals appear in U.S. Pat. No. 3,504,986, issued to Jackson, and U.S. Pat. No. 3,723,019, issued to Berman. An inducer cannot be removed when the flow rate reaches an optimum point, and consequentially may interfere with operation of the pump at its most efficient flow rates.

Other patents which may be of interest are U.S. Pat. Nos. 4,149,825; 3,976,390; 3,901,620; 3,741,676; 3,588,266; 3,268,155; and 3,095,820.

The problems of the prior art devices which are discussed above are not intended to be exhaustive. Other problems may exist. The above discussion does indicate that prior art devices have left room for significant and needed improvement.

SUMMARY OF A PREFERRED EMBODIMENT OF THE INVENTION

In accordance with the present invention, means are provided for reinjecting fluid from the discharge of a centrifugal pump to the impeller inlet through S-shaped passageways. The S-shaped passageways have intake openings near the discharge tips of the impeller which are adapted to receive fluid so that the momentum of the fluid, as it is expelled from the impeller, will carry the fluid directly into the intake of the S-shaped passageways. The S-shaped passageways are shaped to redirect the flow of the fluid to be reinjected so that the fluid exits the S-shaped passageways at the inlet of the impeller in a direction which is at a generally small angle of attack with respect to the impeller vanes. The S-shaped passageways are arranged in side-by-side relation to form an annular reinjection port.

Conveniently, a valve member for selectively closing the S-shaped passageways when reinjection of fluid is not desired may be included.

DETAILED DESCRIPTION OF A PREFERRED EMBODIMENT OF THE INVENTION

Figure 1:
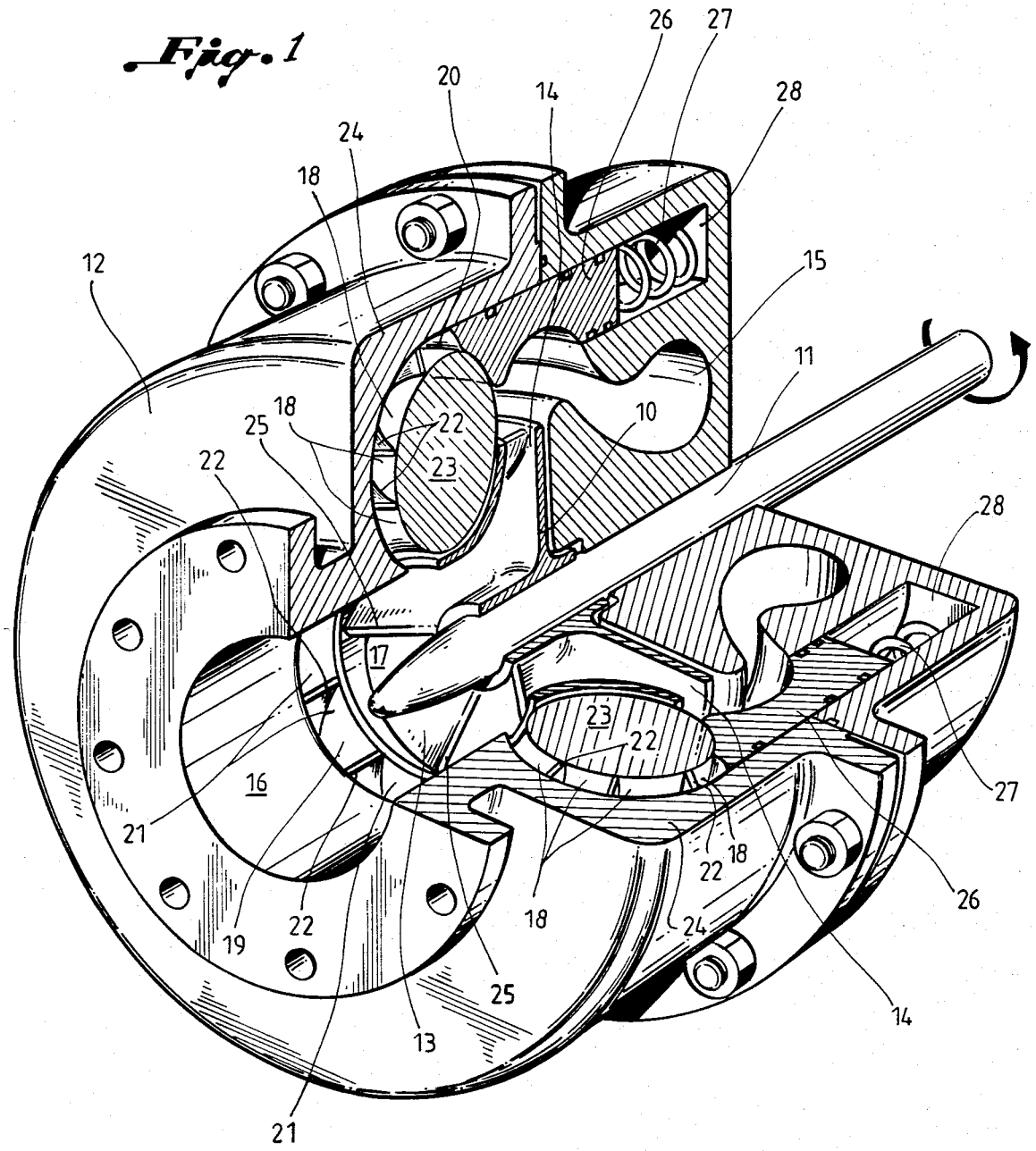
FIG. 1 is a partially cutaway perspective view of a centrifugal pump having reinjection passageways in accordance with the present invention.

Centrifugal pumps include at least one impeller, partially illustrated in FIG. 1 at 10, mounted on a shaft 11. The impeller 10 and shaft 11 are both mounted for rotation in a pump casing 12. Fluid flows through the input 16 into the inlet 13 of the impeller 10. The fluid is expelled radially outwardly through the discharge tips 14 of the impeller 10.

In accordance with the present invention it is desirable to provide redirecting passageways 18 which provide fluid communication between the discharge tips 14 of the impeller 10 and the inlet 13 of the impeller 10. In a preferred embodiment, the passageways 18 are S-shaped.

The S-shaped passageways 18 have intake openings 20 near the discharge tips 14 of the impeller 10 which receive fluid to be reinjected. The S-shaped passageways 18 have outlet openings 21 which are arranged in side-by-side relation to form an annular reinjection port of opening 19.

The S-shaped passageways 18 are defind by vanes 22 which extend between a doughnut-shaped inner casing 23 and an outer casing 24.

Figure 2:
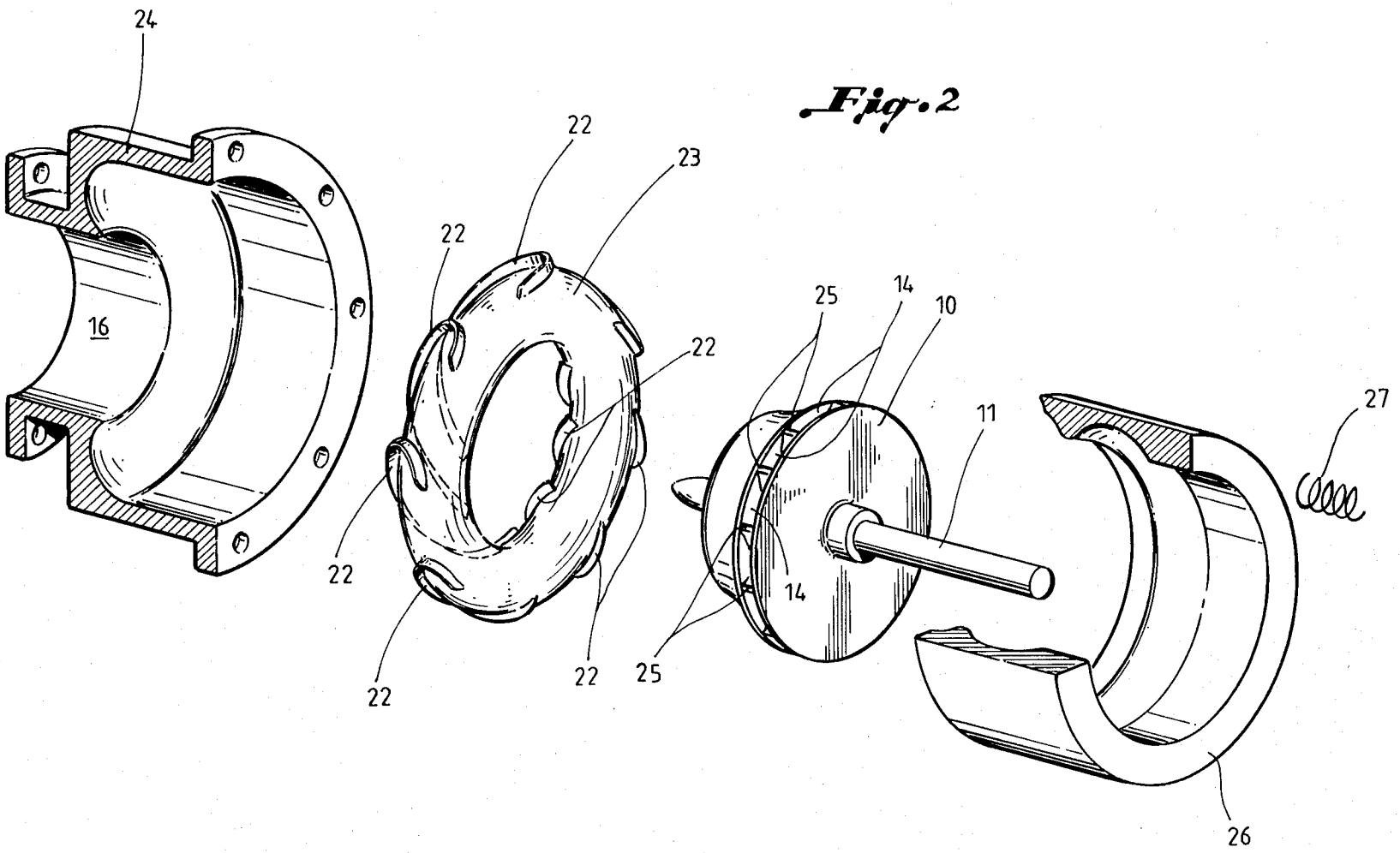
FIG. 2 is a partially cutaway exploded diagram of the centrifugal pump illustrated in FIG. 1.

The vanes 22 may be better described with reference to the exploded view shown in FIG. 2. FIG. 2 shows the vanes 22 and the inner casing 23 separately.

The vanes 22 curve around the inner casing 23 in such a manner that fluid flowing through the S-shaped passageways 18 defined by the vanes 22, the inner casing 23 and the outer casing 24, initially enters the passageways 18 in a direction corresponding to the direction of movement of the fluid at it leaves the discharge tips 14 of the impeller 10. The S-shaped passageways 18 and the vanes 22 then redirect the flow of the fluid such that a rotational movement is imparted to the fluid which is opposite to the direction of rotation of the impeller 10. This accomplishes a reinjection of fluid through an annular reinjection opening 19 such that the reinjected fluid has a low angle of attack with respect to the impeller vanes 25. Reinjection of fluid in this manner is believed to be more effective in controlling or reducing the size of the vortex formed at the suction 17 of the impeller 10 during recirculation.

Reinjection of fluid in the manner provided by the present invention also allows the momentum or kinetic energy of the fluid to help the fluid to be reinjected through the passageways 18, rather than slowing the fluid in a chamber and then reaccelerating it into the inlet 13 of the impeller 10 by a pressure differential. This can best be seen in FIG. 3, and will be explained in more detail below.

Figure 3:
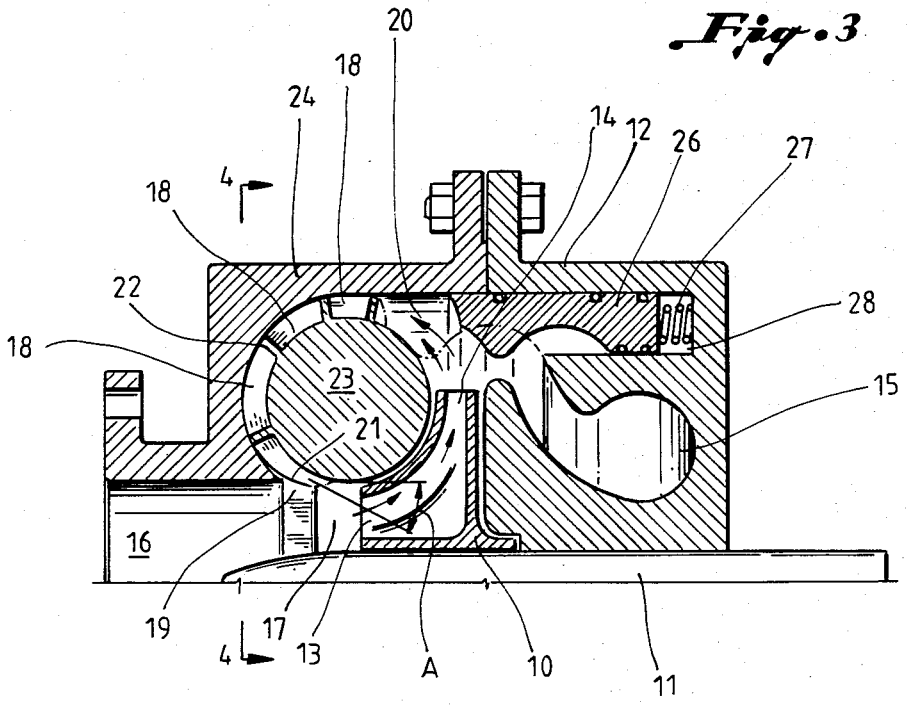
FIG. 3 is a cutaway side view of a portion of the centrifugal pump.

Referring to FIG. 3, the angle of reinjection "A" may be defined as the angle between a line tangent to the inner casing 23 which is parallel to the axis of the shaft 11, and a line which corresponds to the direction in which the fluid is reinjected into the inlet 13 of the impeller 10 as it leaves the reinjection port 19. It is desirable that the angle of reinjection be as small as possible.

It is will be appreciated that the illustrated angle of reinjection "A" does not completely define the direction by which the fluid is reinjected. A rotational movement is also imparted to the fluid by the S-shaped passageways 18 which causes the reinjected fluid to rotate with respect to the axis of the shaft 11 in a direction opposite to the direction of rotation of the impeller 10. This can best be seen in FIG. 4, where the center arrow represents the direction of rotation of the impeller 10, and the two arrows between the vanes 22 represent the flow of fluid as it exits the illustrated passageways 18. The arrow shown in FIG. 5 illustrates the direction of flow of reinjected fluid exiting into the inlet 13 for one of the illustrated passageways 18, as viewed from the side. This counter rotation of the reinjected fluid gives the reinjected fluid a low angle of attack with respect to the impeller vanes or inlet blades 25. The angle of attack is a combination of the angle of reinjection "A" and the direction of flow due to the counter rotation of the reinjected fluid.

Figure 4:
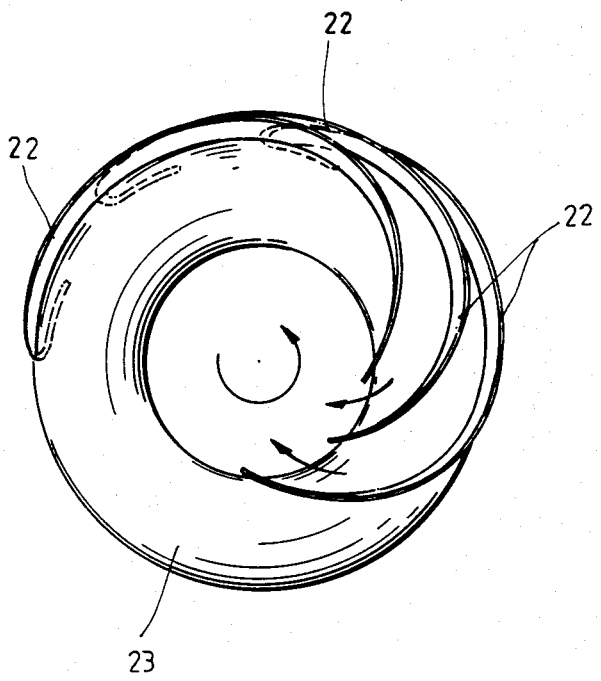
FIG. 4 is a top view of a portion of the pump casing illustrating three of the S-shaped vanes which form the reinjection passageways.
Figure 5:
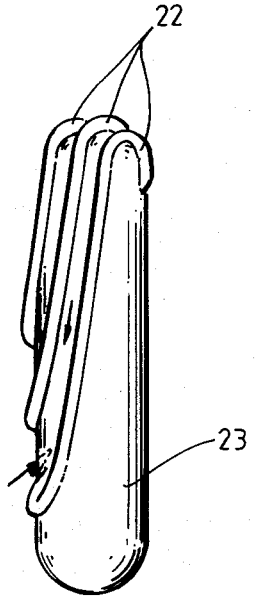
FIG. 5 is a side view of the vanes illustrated in FIG. 4.

FIGS. 4 and 5 further illustrate some of the vanes 22 upon the inner casing 23. Only three vanes 22 are shown, but it should be understood that vanes 22 are preferably located all of the way around the inner casing 23.

A significant aspect of the present invention is the feature that recirculation is controlled or minimized by two simultaneous effects achieved by reinjection in accordance with the teaching contained herein. Reinjection of fluid has the effect of feeding the impeller 10 to increase the apparent flow rate to a higher rate, which tends to prevent starving of the impeller 10, as low flow rates are sometimes referred to in the art. Feeding the impeller 10 tends to raise the pressure at the suction 13 of the pump. Reinjection in the direction and at the location taught herein also has the effect of advantageously using the momentum or kinetic energy of the reinjected fluid to inhibit the formation of a vortex due to recirculation.

To appreciate this dual effect achieved by reinjection in accordance with the present invention, it is necessary to recognize that, in the case of suction recirculation, flow reversal occurs mainly in the vicinity of the circumference of the inlet pipe near the inlet 13 of the impeller 10. Annular reinjection at a low angle of reinjection employs the momentum of the reinjected fluid directly to combat the reversal of flow. Annular reinjection near the inlet 13 of the impeller 10 is critical in order to achieve this dual effect. Reinjection close to the inlet 13 is necessary so that the reinjected fluid will directly interfere with the reversal of flow near the inlet 13 of the impeller 10.

Thus, not only does the increased flow provided by reinjection serve to inhibit recirculation, but the momentum of the reinjected fluid operates to counteract the backflow present during recirculation.

It is important to direct the reinjected fluid directly into the inlet 13 of the impeller 10 where the reinjected fluid has a direction of rotation opposite the direction of rotation of the impeller 10. If the reinjected fluid is not redirected, and instead is allowed to rotate with the impeller 10, the reinjected fluid may affect the pressure field in a way which causes low pressure areas near the impeller vanes 25. The reinjected fluid would have to accelerate to enter the impeller 10, and the pressure in the resultant low pressure areas could drop below the vapor point or flash point of the fluid, causing the sudden formation of a "bubble", or even an explosion. Such "bubbles" can damage the pump, and cause sharp noise. Thus, it is crucial that the reinjected fluid have a low angle of attack with respect to the impeller blades 25. This is accomplished by the S-shaped passageways 18.

It is desirable to have means for controlling fluid communication between the discharge tips 14 of the impeller 10 and the S-shaped passageways 18. When reinjection is not required, fluid communication to the S-shaped passageways 18 should be closed so that the pump can operate at maximum efficiency. In the present instance, this is accomplished by a generally cylindrically shaped valve member 26, shown in FIG. 2.

FIG. 3 shows the valve member 26 in an open position. A dotted line illustrates the position of the valve member 26 when it is in a closed position. The valve member 26 may be actuated by a spring 27, by hydraulic or pneumatic means, or any other convenient arrangement. Hydraulic or pneumatic control may be accomplished using a working space 28 defined by the housing 12 and the valve member 26. Automatic control of the valve member 26 may be accomplished by relating the pressure in the working space 28 to the flow rate through the centrifugal pump, the discharge pressure in the discharge header 15, or to some other parameter which would indicate when reinjection was required.

It is desirable that fluid to be reinjected flow directly into the passageways 18, rather than be slowed in a chamber and then reaccelerated into the passageways 18. In the present invention, this is essentially accomplished by intake openings 20.

The valve member 26 is opened by moving it to the right, as shown in FIG. 3. When the valve member 26 is in the open position, fluid expelled from the discharge tips 14 of the impeller 10 will be carried by its own momentum into the intake openings 20 of the S-shaped passageways 18. The intake openings 20 are directed radially inwardly so that the fluid expelled radially outwardly from the impeller 10 will flow directly into the passageways 18. Thus, the kinetic energy of the fluid is used to carry it into the passageways 18.

The annular reinjection port 19 should be as close to the inlet 13 of the impeller 10 as practical, in order to most effectively control or minimize the formation of a vortex due to recirculation. One way of defining the close proximity of the port 19, is in terms of the diameter of the input 16 of the pump. The annular port 19 should be located sufficiently close to the inlet 13 of the impeller 10 so that it is a distance less than or equal to twice the diameter of the input 16 of the pump. Preferably, the annular port 19 should be located within a distance less than or equal to one half the diameter of the input 16 of the pump.

The intake openings 20 of the S-shaped passageways 18 are preferably directed radially inwardly and facing the discharge tips 14 of the impeller, which expel fluid radially outwardly. The annular port 19 is also directed radially inwardly.

SUMMARY OF ADVANTAGES OF THE INVENTION

It will be appreciated that certain significant advantages are provided by the present invention.

In particular, a centrifugal pump constructed in accordance with the present invention permits operation of the pump over a wider range of flow rates. The formation of a vortex due to recirculating fluid is prevented or minimized to reduce the likelihood of erosion damage to the pump.

Reinjection in accordance with the present invention achieves control of recirculation by simultaneously feeding the impeller to increase the apparent flow rate while also using the momentum of the reinjected fluid to combat flow reversal around the outside circumference of the input to the pump. The annular reinjection of fluid near the inlet of the impeller, in combination with counterrotational reinjection at a low angle of attack with respect to the impeller blades, is believed to be more effective in controlling recirculation than known prior art techniques.

The recirculation passageways provided by the present invention may be closed by the valve member so that they do not interfere with operation of the pump at or near its most efficient flow rates. The present invention achieves control of recirculation without requiring the permanent installation of an inducer or other means which may interfere with operation of the pump at its best efficiency point or flow rates near such point.

The above disclosure provides an example of a presently preferred embodiment of the invention. Although the present invention has been described in conjunction with the specific embodiment of the invention that is illustrated, it is evident that many alternatives, modifications, and variations will be apparent to those skilled in the art after having the benefit of the foregoing disclosure. Accordingly, this description is to be construed as illustrative only, for the purpose of teaching those skilled in the art the manner of carrying out the invention, and is not be construed as a limitation of the invention as defined in the following claims.

What is claimed is:

1. A centrifugal pump having reinjection passageways, comprising:

a centrifugal pump, the pump having an impeller, the impeller having an inlet and discharge tips;

a plurality of S-shaped passageways, the S-shaped passageways providing fluid communication between the discharge tips of the impeller and the inlet of the impeller, the S-shaped passageways being adapted to reinject fluid from the discharge tips to the inlet of the impeller, the S-shaped passageways having intake openings near the discharge tips of the impeller adapted to receive fluid so that the momentum of the fluid, as it is expelled from the discharge tips, will carry the fluid directly into the intake openings of the S-shaped passageways, the S-shaped passageways being shaped to redirect the flow if reinjection fluid so that reinjection fluid exits the S-shaped passageways at the inlet of the impeller at a generally small angle of attack with respect to impeller vanes at the inlet, the S-shaped passageways being shaped to redirect the reinjection fluid so that reinjection fluid exits the S-shaped passageways in a direction which has a component opposite to the direction of rotation of the impeller, the S-shaped passageways being arranged in side-by-side relation to form an annular reinjection port to inhibit undesirable fluid flow patterns in the pump.

2. The centrifugal pump according to claim 1, wherein:

the annular reinjection port is located in close proximity to the inlet of the impeller.

3. The centrifugal pump according to claim 1, wherein:

the pump has an intake opening in fluid communication with the inlet of the impeller, the intake of the pump having a diameter; and, the annular reinjection port is located in close proximity to the intake of the pump within a distance equal to twice the diameter of the intake of the pump.

4. The centrifugal pump according to claim 1, wherein:

the intake openings of the S-shaped passageways further comprise a valve member for selectively closing the S-shaped passageways when reinjection of fluid through the S-shaped passageways is not desired.

5. A centrifugal pump, comprising:

a pump housing;

an impeller rotatably mounted within the housing, the impeller being adapted to pump fluid by expelling the fluid generally radially outwardly when the impeller is rotated, the impeller having an inlet, the impeller further having inlet blades located at the inlet which are adapted to receive fluid and to assist in directing the fluid through the impeller when the impeller is rotated;

the pump housing defining a fluid reinjection path to allow fluid expelled by the impeller to be reinjected back to the inlet blades of the impeller, the fluid reinjection path having an input opening directed so that the momentum of the fluid which is expelled generally radially outwardly by the impeller will assist in carrying a portion of the fluid into the input opening of the fluid reinjection path;

vanes located in the fluid reinjection path to redirect the flow of fluid through the reinjection path so that the fluid exits the reinjection path and impinges upon the inlet blades of the impeller at an angle of attack with respect to the inlet blades which is less than 45°, where the angle of attack is defined as the angle formed by a vector representative of the average velocity of the fluid at the inlet of the impeller, and by the plane of an inlet blade; and, wherein a component of the vector representative of the average velocity of the fluid lies in a plane perpendicular to the axis of the impeller, and, due to rotation of the fluid in a direction opposite to rotation of the impeller, said component is in a direction generally opposite to the direction of rotation of the impeller.

6. The centrifugal pump according to claim 5, wherein the angle of attack of the recirculated fluid impinging upon the inlet blades of the impeller is less than 15°.

7. The centrifugal pump according to claim 5, or claim 6, wherein the fluid exits the reinjection path immediately adjacent the inlet blades of the impeller.

8. The centrifugal pump according to claim 5, or claim 6, wherein the pump housing has an input opening having a diameter, and the fluid exits the reinjection path at a distance remote from the inlet blades which distance is less than twice the diameter of the input opening of the pump housing.

9. The centrifugal pump according to claim 8, wherein the distance is less than one half the diameter of the input opening of the pump housing.

10. The centrifugal pump according to claim 5, or claim 6, wherein the fluid reinjection path provides annular reinjection of fluid.

11. The centrifugal pump according to claim 5, wherein said component of the vector representative of the average velocity of the reinjected fluid, which component is in said plane perpendicular to the axis of the impeller, is generally equal in magnitude to the magnitude of the velocity of the inlet blades of the impeller.

12. A centrifugal pump having reinjection means, comprising:

a centrifugal pump having an impeller rotatably mounted therein, the impeller having an input and an output, the impeller having an axis about which it rotates; and, a plurality of reinjection passageways, the reinjection passageways providing fluid communication from the output of the impeller to the input of the impeller to reinject fluid near the input of the impeller, the reinjection passageways being shaped to redirect the flow of fluid traveling through the reinjection passageways so that the fluid exiting the reinjection passageways has a direction of rotation in a plane perpendicular to the axis of the impeller, which direction of rotation is generally opposite to the direction of rotation of the impeller.

13. The centrifugal pump according to claim 12, wherein the reinjection passageways are substantially S-shaped.

14. The centrifugal pump according to claim 12 or claim 13, wherein the reinjection passageways are arranged in generally side-by-side relation to form an annular reinjection port.

15. A method for recirculating fluid through a centrifugal pump, comprising the steps of:

receiving fluid downstream from an impeller of a centrifugal pump;

redirecting the fluid to impart a direction of rotation to the fluid which is opposite to the direction of rotation of the impeller; and annularly reinjecting the fluid upstream and immediately before the impeller of the centrifugal pump to reduce the likelihood of formation of undesirable flow patterns, by simultaneously increasing the apparent flow rate through the impeller and using the momentum of the fluid to combat flow reversal.

16. A centrifugal pump, comprising:

a pump housing;

an impeller rotatably mounted within the housing, the impeller being adapted to pump fluid by expelling the fluid generally radially outwardly when the impeller is rotated, the impeller having inlet blades adapted to receive fluid and assist in directing the fluid through the impeller when the impeller is rotated;

the pump housing defining a fluid reinjection path to allow fluid expelled by the impeller to be reinjected back to the input blades of the impeller, the fluid reinjection path having an input opening directed generally radially inwardly so that the momentum of the fluid which is expelled generally radially outwardly will assist in carrying a portion of the fluid into the input opening of the fluid reinjection path;

vanes located in the fluid reinjection path to redirect the flow of fluid through the reinjection path so that the fluid exists the reinjection path and impinges upon the input blades of the impeller at a generally small angle of attack with respect to the input blades; and, the vanes and housing defining a plurality of redirecting passageways to gradually redirect the flow of a portion of the fluid which is expelled radially outwardly by the impeller such that a rotation is imparted to the fluid with respect to the axis of rotation of the impeller which rotation is opposite in direction to the direction of rotation of the impeller.

17. The centrifugal pump according to claim 16, wherein the vanes are generally S-shaped.

18. The centrifugal pump according to claim 16 or claim 17, wherein the redirecting passageways are arranged in generally side-by-side relation to form an annular reinjection port.

19. The centrifugal pump according to claim 16, wherein the angle of attack of the recirculated fluid impinging upon the input blades of the impeller is less than 15°.

20. The centrifugal pump according to claim 16, claim 17, or claim 19, wherein the fluid exits the reinjection path immediately adjacent the input blades of the impeller.

21. The centrifugal pump according to claim 16, claim 17, or claim 19, wherein the pump housing has an input opening having a diameter, and the fluid exists the reinjection path at a distance remote from the input blades which distance is less than twice the diameter of the input opening of the pump housing.

22. The centrifugal pump according to claim 21, wherein the distance is less than one half the diameter of the input opening of the pump housing.

23. The centrifugal pump according to claim 16, wherein:

the fluid reinjection path forms an annular reinjection port;

the pump has an intake opening in fluid communication with the inlet of the impeller, the intake of the pump having a diameter; and, the annular reinjection port is located in close proximity to the intake of the pump within a distance equal to twice the diameter of the intake of the pump.

24. The centrifugal pump according to claim 16, wherein:

the input opening of the fluid reinjection path further comprises a valve member for selectively closing the fluid reinjection path when reinjection of fluid through the fluid reinjection path is not desired.

25. The centrifugal pump according to claim 16, wherein the angle of attack of the reinjection fluid impinging upon the input blades of the impeller is less than 45°.

* * * * *

UNITED STATES PATENT AND TRADEMARK OFFICE

CERTIFICATE OF CORRECTION

PATENT NO. : 4,492,516

DATED : January 8, 1985

INVENTOR(S) : James J. McCoy, Jr.

It is certified that error appears in the above-identified patent and that said Letters Patent is hereby corrected as shown below:

Column 4, line 15, change "of" to -- or --; line 16, change "defind" to -- defined --; line 27, change "at" to -- as --; line 41, after "help" insert -- move --; line 55, delete "is".

Column 7, line 35, change "if" to -- of --.

Column 9, line 3, after "that", insert -- a rotation is imparted to the fluid such that --; line 50, change "exists" to -- exits --.

Column 10, line 25, change "exists" to -- exits --.

Signed and Sealed this

*Eighth* Day of *October 1985*

[SEAL]

*Attest:*

*Attesting Officer*

DONALD J. QUIGG

*Commissioner of Patents and Trademarks—Designate*